United States Patent [19]

Winetzky

[11] Patent Number: 4,615,814

[45] Date of Patent: Oct. 7, 1986

[54] POROUS SUBSTRATE WITH ABSORBED ANTISTAT OR SOFTENER, USED WITH DETERGENT

[75] Inventor: Deborah Winetzky, Torrance, Calif.

[73] Assignee: Purex Corporation, Lakewood, Calif.

[21] Appl. No.: 596,037

[22] Filed: Apr. 2, 1984

[51] Int. Cl.[4] ..... D06M 11/00

[52] U.S. Cl. ..... 252/8.6; 252/8.8; 252/8.9; 252/528; 252/135; 252/546

[58] Field of Search ..... 252/8.9, 8.8, 547, 528, 252/8.6, 135

[56] References Cited

U.S. PATENT DOCUMENTS

| | | | |
|---|---|---|---|
| 3,686,025 | 8/1972 | Morton et al. | 117/140 R |
| 3,861,870 | 1/1975 | Edwards et al. | 8/115.6 |
| 3,896,033 | 7/1975 | Grimm, III | 252/8.8 |
| 3,986,987 | 10/1976 | D'Souza | 252/527 |
| 4,018,688 | 4/1977 | Pracht | 252/8.6 |
| 4,049,557 | 9/1977 | Wixon | 252/8.8 |
| 4,051,046 | 9/1977 | Diehl et al. | 252/8.6 |
| 4,062,647 | 12/1977 | Storm et al. | 8/137 |
| 4,075,117 | 2/1978 | Morton et al. | 252/135 |
| 4,081,384 | 3/1978 | Pracht | 252/8.8 |
| 4,108,800 | 8/1978 | Froehlich et al. | 252/541 |
| 4,190,551 | 2/1980 | Murata et al. | 252/99 |
| 4,203,851 | 5/1980 | Ramachandran | 252/8.6 |
| 4,210,550 | 7/1980 | Cornellissens | 252/90 |
| 4,250,043 | 2/1981 | Jones | 252/8.6 |
| 4,272,386 | 6/1981 | Draper et al. | 252/8.6 |
| 4,276,205 | 9/1981 | Ferry | 252/528 |
| 4,284,627 | 11/1980 | Schilling | 427/242 |
| 4,292,035 | 9/1981 | Battreu | 8/137 |
| 4,298,480 | 11/1981 | Wixon | 252/8.75 |
| 4,326,971 | 4/1982 | Wixon | 252/8.75 |
| 4,329,237 | 5/1982 | Wixon | 252/8.75 |
| 4,399,049 | 8/1983 | Gray et al. | 252/91 |
| 4,419,250 | 12/1983 | Allen et al. | 252/8.6 |

FOREIGN PATENT DOCUMENTS

| | | |
|---|---|---|
| 0000416 | 1/1979 | European Pat. Off. . |

*Primary Examiner*—Paul Lieberman
*Assistant Examiner*—Willie Thompson
*Attorney, Agent, or Firm*—William W. Haefliger

[57] ABSTRACT

A bead, useful in a fabric aqueous laundering process to impart to the fabric, when dried, at least one of the properties (i) softness, and (ii) antistatic effect, comprises a porous substrate, and substance absorbed onto said substrate to produce at least one of said (i) and (ii) properties in the fabric. A barrier layer may be formed about said substrate and characterized as dispersing in laundry wash water; a solubilizing or dispersion aid such as a nonionic surfactant may be mixed with said substance and also absorbed onto the substrate; and a hardener may be mixed with said substance and also absorbed onto the substrate.

23 Claims, No Drawings

POROUS SUBSTRATE WITH ABSORBED ANTISTAT OR SOFTENER, USED WITH DETERGENT

BACKGROUND OF THE INVENTION

This invention relates to the compositions of beads containing a fabric softener/antistat and a process for their production. In addition, the invention relates to detergent-softener compositions capable of imparting improved softness and antistatic properties to treated fabrics in the machine laundering process.

At present, many detergent-softener compositions are available on the market which claim to clean, soften, and reduce static cling without additional treatment steps. One popular type is the liquid detergent softener. These tend to be largely antistats and in actuality provide very little softening. In addition, their soil removal efficiency is lower than conventional spray dried detergents. Another type is the dry detergent softener. These compositions contain a high percentage of clays which tend to deposit on the treated fabric. The deposition of the clay is supposed to provide a talcum powder like softness, but it also tends to discolor whites. These same compositions may also contain water-insoluble fabric softener capsules or prills which attach themselves to fabrics in the wash cycle and melt in the clothes dryer to release the softener compound. The above mentioned two types of detergent softener compositions are typically formulated to avoid unfavorable interactions between anionic surfactants, the most commonly used type of surfactant, and cationic softeners. Furthermore, they are formulated to avoid the use of large amounts of alkaline builder. Cationic softener/antistats in an alkaline environment degrade into amines giving off undesirable odors, tend to develop undesirable color, and lose effectiveness. No one has been able successfully to add a cationic fabric softener/anti-stat to a high alkalinity detergent without the limiting problems listed above. The present invention provides a means which circumvents the above situations.

SUMMARY OF THE INVENTION

It is a major object of the invention to provide compositions avoiding the above problems and difficulties. Basically, the invention concerns the provision of a bead or beads, useful in aqueous laundering of fabrics, and imparting to such fabrics, when dried, desirable softness and/or antistat properties, the bead comprising a porous substrate and substance such as cationic surfactant absorbed onto the substrate and capable of producing one or both of such properties. As will appear, the substrate is typically selected from the group that consists of puffed borax and dendritic salt; and the substance absorbed onto the bead is typically selected from the group consisting of quaternary ammonium compounds and imidazolinium compounds.

It is a further object of the invention to provide solubilizing or a dispersion aid mixed with the absorbed substance, that aid typically comprising nonionic surfactant, an amphoteric or zwitterionic compound, or fatty acid soaps. Also, a hardener such as a wax or high molecular weight polyethylene glycol may be incorporated, i.e. mixed with the softening and/or antistat substance absorbed onto the bead.

It is a still further object to provide a barrier layer or coating on the resulting bead to eliminate tackiness between the beads, and also to act as a barrier between the cationic surfactant and the detergent (typically heavy duty, dry, and carbonate based) to which the beads are added.

It is a still further object of the invention to provide a method of producing the described beads, as will appear.

The finished fabric softener beads may then be added to any dry detergent. The dry detergent may be spray dried, dry mixed, or agglomerated. It may contain anionic, nonionic, amphoteric, or zwitterionic surfactants, or any mixture thereof. Other ingredients typically found in detergent compositions may also be included such as bleaching agents, bleach activators, suds boosters or suppressors, anticorrosion agents, soil suspending agents, soil release agents, optical brighteners, hydrotropes, enzymes, water softeners, perfumes, and other typical detergent additives.

Accordingly, the present invention enables the introduction of a fabric softener/antistat into the unfavorable environment of an alkaline dry detergent, the resulting product of detergent fabric softener/antistat to be applied to fabrics in the home laundry process, specifically the wash cycle.

DETAILED DESCRIPTION

The bead of the present invention is comprised of a porous substrate into which is absorbed a fabric softener or antistat, the resultant bead preferably coated with a protective barrier which disperses in laundry wash water.

The substrate granule diameter or cross dimension lies within the range 0.05 and 2.0 mm; the softener/antistat substance is absorbed into the interstices or porosity of the substrate; and the barrier coat covers the substrate and absorbed substance and has an average coating thickness between 1 micron and 1.0 mm; and the resultant bead has a diameter or cross dimension within the range of 0.05 and 4.0 mm.

The substance adsorbed onto or into the porous substrate granule in addition to comprising a fabric softener/antistat may optionally include a dispersion aid and/or a hardener, mixed with the softener/antistat.

The fabric softener bead composition, as well as the composition of the materials used in forming the bead, is as follows:

(a) from about 1% to 90% by weight of a porous substrate, such as puffed borax, (a product of Expanded Products Inc. or McGean Chemical Co.) dendritic salt, or clay;

(b) from about 0.5% to about 75% by weight of a substance comprising:

(1) from about 1% to 100% by weight of a material or mixture of materials known in the art to provide useful softening and/or antistatic effects on textiles (usually alkyl quaternary ammonium or imidazolinium compounds);

(2) optionally, and preferably from about 1% to 100% by weight of a suitable solubilizing or dispersion aid admixed with (1). Such aids may be selected from the group consisting of nonionic, amphoteric or zwitterionic surfactants, or fatty acid soaps;

(3) optionally, and preferably from about 0.1 to 25% by weight of a hardener, such as a wax or high M.W. polyethylene glycol, admixed with (1);

(c) from about 1% to about 30% by weight of a finely divided solid which provides an external coating on the bead, acts as a barrier and removes tackiness. Such a solid is selected from the group consisting of amorphous silica, inorganic salts, starch, and other anti-tacky materials that dissolve in wash water.

The beads are manufactured in a suitable mixer, preferably one which provides gentle agitation. The substrate material is charged into the mixer, and the softener mix is applied. Once all of the substrate is coated with the softener mixture, then the finely divided solid is slowly charged into the mixer, in an amount sufficient to coat the beads and make them free flowing.

Fabric softener/antistats useful herein are those materials, or mixtures of materials, known in the art which provide useful softening and/or antistatic effects. This component is to be used in an amount from 0.5 to 100%, preferably from about 5% to 75%, and most preferably from 5% to 50%. Most preferred are the cationic types, such as quaternary ammonium compounds and quaternary imidazolinium compounds.

Quaternary ammonium compounds may be structurally defined as

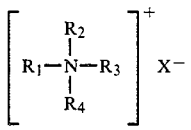

where $R_1$ represents an aliphatic group of from 1 to 22 carbon atoms, or hydrogen; $R_2$ represents an aliphatic group of from 12 to 24 carbon atoms; $R_3$ and $R_4$ represent alkyl groups of from 1 to 3 carbon atoms; X represents an anion selected from the group consisting of halogen, sulfate, methylsulfate, phosphate, nitrate, and acetate. For example, ditallow dimethyl ammonium chloride, distearyl dimethyl ammonium methyl sulfate, hydrogenated tallow trimethyl ammonium chloride, etc.

Quaternary imidazolinium compounds may be structurally defined as follows:

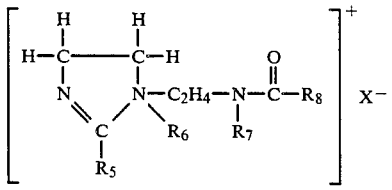

Where $R_5$ represents an aliphatic group of from 1 to 22 carbon atoms or hydrogen; $R_6$ represents an alkyl group of from 1 to 4 carbon atoms; $R_7$ represents an alkyl group of from 1 to 4 carbon atoms or hydrogen; and $R_8$ represents an aliphatic group of from 8 to 24 carbon atoms; and x is an anion as mentioned previously. For example, methyl-1-hydrogenated tallow amido ethyl-2 hydrogenated tallow imidazolinium methyl sulfate, methyl-1-tallow amido ethyl-2-tallow imidazolinium chloride, methyl-1-oleylamido ethyl-2-tallow imidazolinium methyl sulfate, 1-ethylene bis(2-tallow-1-methyl imidazolinium chloride).

Other useful quaternary ammonium compounds include dimethyl alkyl (C10–C18) benzyl chlorides, complex diquaternary chlorides, diamidoamine based methyl sulfates, and various other quaternary derivatives.

The solubilizing or dispersion aid may be chosen from a wide variety of materials. This component is to be used in the range from 0.5% to 100%, preferably from 5% to 80% and most preferably from 10% to 75%. Most preferred are nonionic surfactants, which generally are the condensation products of an alkylene oxide and an organic hydrophobe. Several classes of these compounds exist, they include the following (a) Condensation products of aliphatic alcohols with ethylene oxide. The aliphatic alcohol usually contains either branched or straight alkyl groups from about 8 to about 24 carbon atoms. Examples of this type of nonionic include the Neodols marketed by the Shell Chemical Co. the Alfonics marketed by the Conoco Chemical Co. and some of the Tergitols marketed by the Union Carbide Corp.

(b) Polyethylene oxide condensates of alkyl phenols. The alkyl group of the alkyl phenol generally contains from 6 to 14 carbon atoms in either a straight chain or branched configuration. Examples of this type of nonionic include the Igepals marketed by GAF Corp. the Plurafacs marketed by BASF Wyandotte, and some of the Tergitols marketed by the Union Carbide Corp.

(c) Condensation products of ethylene oxide and an organic hydrophobic base. The addition of ethylene oxide to the hydrophobic base portion increases the water solubility of the molecule. Examples of this type of nonionic include the Polyfacs marketed by Westvaco Polychemicals and the Pluoronics marketed by BASF Wyandotte.

(d) Tertiary amine oxides with the general structure $R_1R_2R_3NO$. $R_1$ represents an alkyl group containing from 10 to about 28 carbon atoms. $R_2$ and $R_3$ represent alkyl groups containing from 1 to about 3 carbon atoms. Examples of this type of nonionic include the Jordomoxes marketed by Jordan Chemicals, and the Alkamoxes marketed by Alkaril Chemicals.

(e) Sulfoxide surfactants having the formula

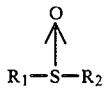

where $R_1$ represents an aliphatic group containing from 10 to about 28 carbon atoms and may include up to 5 ether linkages and up to 2 hydroxyl groups. $R_2$ represents an alkyl group containing from 1 to about 3 carbon atoms and up to 2 hydroxyl groups. Examples of this type of surfactant are dodecylethyl sulfoxide, octadecyl methyl sulfoxide, and 3-hydroxytridecyl methyl sulfoxide.

(f) Phosphine oxide surfactants having the formula:

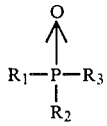

where $R_1$ represents an aliphatic group of from 10 to about 28 carbon atoms and up to 2 hydroxyl groups and up to 5 ether linkages. $R_2$ and $R_3$ represents an alkyl or an hydroxyalkyl group containing from 1 to about 3 carbon atoms. Examples of this type of surfactant include diethyldodecylphosphine oxide, cetylethylpropylphosphine oxide, and bis-(2-hydroxyethyl)dodecylphosphine oxide.

Other useful solubilizing or dispersion aids include the following:

(a) Ampholytic surfactants which contain both anionic and cationic moieties. The anionic group is usually a carboxyl, sulfonic ester or sulfuric ester. The cationic group is usually a substituted nitrogen, i.e. a secondary or tertiary amine or ammonium. Examples of this type of surfactant include the Jortaines marketed by Jordan Chemicals, and some of the Sipons marketed by Alcolac Inc.

(b) Zwitterionic surfactants which also contain both anionic and cationic moieties:

(1) Compounds which can be structurally defined as follows:

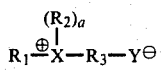

$R_1$ represents an alkyl, hydroxyalkyl or alkenyl group containing from 8 to about 20 carbon atoms, and optionally ethylene oxide. X represents a nitrogen, sulfur, or phosphorous atom. $R_2$ represents an alkyl or hydroxyalkyl group containing from 1 to about 3 carbon atoms, "A" equals 1 when X is sulfur and, 2 when X is nitrogen or phosphorous. $R_3$ represents an alkylene or hydroxyalkylene group containing from 1 to about 5 carbon atoms. Y represents a sulfonate, sulfate, phosphate, phosphonate, or carboxy group.

(2) Compounds which can be structurally defined as:

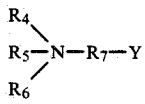

Where $R_4$ represents an alkyl or hydroxyalkyl group containing from 1 to about 7 carbon atoms, or it may be the same as $R_5$. $R_5$ represents an alkarylmethylene group containing from 8 to about 24 carbon atoms in the alkyl chain. $R_6$ represents an alkyl or hydroxyalkyl group containing from 1 to about 7 carbon atoms. $R_7$ represents an alkylene or hydroxyalkylene containing from 1 to about 7 carbon atoms. Y can be a sulfate, sulfonate, or carboxy group. Examples of this type of zwitterionic surfactant include 3-(N-hexadecyl-benzyl-N N-dimethylammonio)propane-1-sulfate, 4[N,N-di(hexadecylbenzyl)-N-methylammonio]butyrate, and 3-(N-dodecylbenzyl-N,N-dimethylammonio)-2-hydroxypropane-1-sulfonate.

(3) Compounds which can be structurally defined as

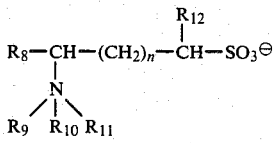

where $R_8$ represents an alkyl group. $R_{12}$ represents a hydrogen or an alkyl group containing from 4 to about 8 carbon atoms. $R_9$, $R_{10}$, and $R_{11}$ represent a quaternary ammonium group in which each R is an alkyl or hydroxyalkyl group or the three may be joined in a heterocyclic ring. 'n' can be 1 or 2 methyl groups. Examples of this type of zwitterionic surfactant include the hexadecyl trimethylammoniom sulfobetainas.

(4) Compounds which can be structurally defined as

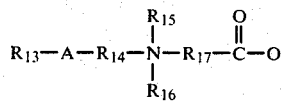

where $R_{13}$ represents an alkyl or alkaryl group containing from 10 to about 20 carbon atoms. 'A' represents a bivalent radical selected from carbonylamino, amino-carbonyl, carbonyloxy, aminocarbonylamino, and similar corresponding thio groups, as well as substituted amino derivatives. $R_{15}$ and $R_{16}$ are alkyl or hydroxyalkyl groups containing from 1 to 10 carbon atoms. $R_{16}$ may also include "$R_{13}$—$AR_{14}$," or $R_{17}$—COOAe where $R_{13}$, $R_{14}$, $R_{15}$ and $R_{17}$ are defined above and Ae is a monovalent salt-forming cation. Examples of this type of zwitterionic surfactant include N,N-bis(-stearamidopropyl-N-methyl-N-carboxymethylammonium betaine, and N,N-bis(oleylamidopropyl)-N-(Z-hydroxyethyl)-N-carboxymethyl-ammonium betaine.

(5) Compounds which can be structurally defined as:

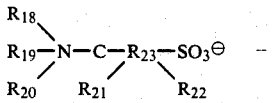

where $R_{18}$ and $R_{20}$ represent aliphatic groups containing from 1 to about 5 carbon atoms. $R_{19}$ represents an alkylphenyl, cycloalkylphenyl or alkenylphenyl group containing from 8 to 20 carbon atoms in the aliphatic moiety. $R_{21}$ and $R_{22}$ represent an alkyl group containing from 1 to about 3 carbon atoms, or hydroxyl groups or hydrogen. $R_{23}$ represents an alkylene group containing from 2 to about 4 carbon atoms. Examples of this type of zwitterionic surfactant include 4-(N-hexadecylphenyl-N,N-dimethyl)butane-1-sulfonate and 3-(N-dodecylphenyl-N,N-dimethyammonic)-3 hydroxypropane-1-sulfonate.

(c) The last catagory is fatty acid soap.

A hardening agent may also be added to the mixture to make a faster setting mixture and a crisper, stronger bead. This component is to be used in an amount from 0% to 30%, preferably from 2% to 15% and most preferably from 2% to 8%. The hardening agent may be selected from the group consisting of, but not limited to the following: polyethylene glycol MW=4000, or 6,000, paraffin wax, solid nonionic surfactants (examples being IGEPAL CO-880, from GAF; ALFONIC 1412-60, from CONOCO CHEMICALS; NEODOL 25-12 from SHELL) and natural animal or vegetable waxes (examples being BEE'S WAX, CARNAUBA WAX, and CANDELILLA WAX).

The liquid applied to the substrate may also be used as a carrier for dyes, optical brightness, liquid enzymes, perfumes.

The final fabric softener/antistat mixture is to be used in an amount from 0.5 to 75% of the final weight of the bead. It is best if the fabric softener/antistat mixture completely coats but does not dissolve the substrate, for physical and economic reasons.

The porous substrate may be chosen from a variety of materials. It may be selected from a group containing, but not limited to, puffed borax, a spray dried bead lacking anionic surfactant, clays such as BENTONITE, BENTOLITE L2, VOLCLAY SPV-200 and various porous crystals such as dendritic salt. This component of the fabric softener bead is to be used in an amount from 10% to 85%, preferably from 20% to 70% and most preferably from 30% to 60%, by weight.

The barrier layer may be chosen from a variety of materials. It may be selected from a group containing, but not limited to, amorphous silica, inorganic salts such as sodium sulfate, sodium chloride, zinc sulfate, starch and powdered dyes, such as HIDACID AZURE BLUE, from HILTON-DAVIS; ALPHAZURINE 2G from KEYSTONE, and POLAR BRILLIANT BLUE RAWL 110% from CIBA-GEIGY. Essentially, it can be any finely divided solid, preferably one that is not too alkaline. Furthermore, it should be soluble in water. This component of the fabric softener/antistat bead is to be used in an amount from 0.5% to 30%, preferably from 5% to 20% and most preferably from 7% to 15% by weight.

The production of the fabric softener/antistat bead is a two step process. Any conventional mixer can be used in production, for example, a P-K blender, a Marion mixer, or a ribbon mixer, preferably, a mixer providing a gentle mixing action. In the first step of the process, the substrate is charged into the mixer, and the mixer started. Next, the fabric softener/antistat mixture is applied via a spray nozzle or other suitable means. Once all of the fabric softener mixture is charged into the mixer and completely absorbed, the next step in the process is to apply the barrier material. The barrier material should completely coat the beads and make them free flowing before the mixer is discharged.

EXAMPLE 1.65 lbs. of puffed borax beads were charged into the mixer; next, 1.60 lbs. of fabric softener/antistat mixture 47.5% ARMAK RD 5444A/47.5% NEODOL Z3-6.5/5% CARBOWAX 4000 was sprayed into the beads, during their mixing, and mixing was continued (about 3–5 minutes) until the softener/antistat was completely absorbed. Next, 0.45 lbs. of barrier in the form of amorphous silica powder were charged into the mix, and mixing continued about 5–7 minutes. The resulting coated beads were free flowing and non-tacky.

In the above, the following commercial designations refer to compositions as indicated:

sodium LAS is sodium linear dodecyl-benzene sulfonate;

Sulframin 85 is a powder or flake containing about 81% sodium linear dodecyl-benzene sulfonate, and the balance moisture and sodium sulfate;

Sodium CMC is sodium carboxymethyl cellulose.

The fabric softener/antistat bead may be applied to fabric in the machine laundering process via a dry laundry detergent. It can be admixed with spray dried detergents, dry mixed detergents, or agglomerated detergents. These detergents may or may not contain phosphate builders. They can contain any of the typical laundry detergent additives, such as optical brighteners, dyes, perfumes, soil anti-redeposition agents, soil suspending agents, soil release agents, water softeners, bleaches, bleach enhancers, suds boosters or suppressors, anti-corrosion agents, hydrotropes, enzymes, etc.

The following examples are illustrative of usable bead formulations:

| Ingredient | % by weight |
|---|---|
| (1) puffed borax | 33.8 |
| Accosoft 550 HHV - proprietary mixture containing methyl difatty alkoxy ammonium sulfate quaternay | 32.2 |
| PM 5108 absorbant (from PQ Corp.) | 34.0 |
| (2) puffed borax | 23.9 |
| Armak RD 5444A - proprietary cationic fabric softener | 23.9 |
| Flogel 60 (from National Starch) starch | 52.2 |
| (3) puffed borax | 45.4 |
| Armak RD 5444A - proprietary cationic fabric softener | 45.4 |
| Sipernat 50S (from Degussa) (silica) | 9.2 |
| (4) puffed borax | 47.6 |
| 27.8% Armak - proprietary RD 5444A/67.1% Neodol-primary alcohol ethoxylate 23-6.5/5.2% Carbowax 4000 Polyethylene Glycol | 42.0 |
| Sipernat 50S (silica) | 10.4 |
| (5) puffed borax | 40.5 |
| 47.5% Armak - Proprietary RD 5444A/47.5% Igeapal - Nonyl Phenoxypoly (Ethyleneoxy) Ethanol CO-710/5.0% Carbowax 4000 Polyethylene Glycol | 46.0 |
| Sipernat 50S (silica) | 13.5 |

All of the above beads were non-tacky and free flowing. All were suitable for addition to a dry laundry detergent.

The following are sample detergent formulations to which fabric softener/antistat bead has been added:

| Ingredient | % by weight |
|---|---|
| (1) Sodium LAS | 15.5 |
| Sodium silicate (1:2.4) (solids) | 8.0 |
| Sodium carbonate | 24.25 |
| Sodium sulfate | 44.0 |
| perfume/dye/FWA/CMC | q.s. |
| fabric softener bead (#5 from above) | 6.4 |
| (2) Sodium LAS | 12.7 |
| Sodium silicate (1:2.4) (solids) | 7.9 |
| Sodium carbonate | 24.25 |
| Sodium sulfate | 50.4 |
| perfume/dye/FWA/CMC | q.s. |
| fabric softener bead | 7.7 |
| (3) Sodium Chloride | 26.0 |
| Britesil H24P (Sodium Silicate) | 15.0 |
| Sodium percarbonate | 6.0 |
| Sulframin 85 (Sodium LAS) | 38.0 |
| Sodium CMC | 0.7 |
| Esperase 4.0 T (Protease Enzyme) | 2.0 |
| perfume/dye | 0.3 |
| fabric softener bead (#5 from above) | 12.0 |

All three of the above formulas exhibit good soil removal performance and provide noticable softening.

Other suggested formulas are:

| Ingredient | % by weight |
|---|---|
| (4) Sodium LAS | 14.0 |
| Sodium tripolyphosphate | 25.0 |
| Sodium silicate (1:2.4) (solids) | 8.0 |
| Sodium CMC | 0.4 |
| Sodium sulfate | q.s. |
| dye/perfume | 0.2 |
| Fabric softener bead (#4 from above) | 7.5 |
| (5) Sodium Sesquicarbonate | q.s. |

-continued

| Ingredient | % by weight |
|---|---|
| Sodium carbonate | 40.0 |
| Sodium chloride | 15.0 |
| Sodium CMC | 0.2 |
| Sodium LAS | 7.5 |
| dye/perfume/FWA | 0.15 |
| Fabric Softener bead (#3 from above) | 12.0 |
| (6) Sodium linear dodecyl - benzene sulfonate (LAS) | 15.0 |
| Sodium carbonate | 25.0 |
| Sodium silicate (1:2.4) | 9.0 |
| Fabric softener *(solids) | 2.5 |
| Sodium sulfate | 8.5 |

*(puffed borax - 35-15%
Cationic - 25-50%
Silica - 5-25%)
(SIPERNAT 50S or Syloid 74)

Odor stability tests were run on detergent formulation #2 above. Samples were set up at 110° F., room temperature; and 80° F., 80% relative humidity. The fabric softener beads with several different barrier layers were tested, and no unpleasant odors developed in any of the samples after four months of testing. However, when Armak RD 5444A was absorbed directly onto a spary dried, carbonate-based detergent, a slight amine odor developed at 80° F., 80% relative humidity. When a dimenthyl ditallow quaternary was absorbed directy onto detergent #2 (without fabric softener beads), an amine odor developed under all three environmental conditions. This data indicates that applicant's method of absorbing fabric softener into puffed borax or equivalent porous substrate, eliminates odor stability problems encountered when fabric softener is added to a carbonate-based, or similar high alkalinity detergent.

In detergent formulations to which beads as disclosed above have been added, the beads typically comprise between 0.01 and 50.0 percent, by weight, of the composition. The detergent may be spray dried, dry mixed or agglomerated.

Other detergents to which the disclosed beads may be added are characterized by the following composition:

(1) Surfactants (as previously described above), nonionic, zwvitterionic, amphoteric
(2) Anionic surfactants: alkali metal, ammonia or amine salts of alkylbenzene sulfonate, ethoxylated sulfates, alpha olefin sulfonates, alcohol sulfates, etc.
(3) builders: alkali metal salts of polyphosphates, orthophosphates, silicates, sulfate, chloride, citrate, carbonate, bi-carbonate, zeolites, nitrilotriacetic acid, ethylene diaminetriacetic acid, etc.
(4) additives: bleaching agents, bleach activators, suds boosters or suppressors, anticorrosion agents, soil suspending agents, soil release agents, optical brighteners, hydrotropes, enzymes, water softeners, and perfumes.

Finally, it appears that substantially all of the bead and its coating, as described above, dissolves in the warm wash water, during the wash cycle.

An example of a usable dendritic salt is dendritic sodium chloride.

I claim:

1. A bead useful in a fabric aqueous laundering process to impart to the fabric, when dried, at least one of the properties (i) softness, and (ii) anti static effect, said bead comprising (a) a porous substrate,
(b) substance absorbed into said substrate to produce at least one of said (i) and (ii) properties in the fabric, said substance being cationic, and
(c) a water dispersable barrier coating consisting of an ingredient selected from the group that consists of amorphous silica, inorganic salts, starch and powdered dyes, on the substrate and covering said substrate and absorbed substance to allow quick release of the said coating in laundry wash water, the coating average thickness being between about 1 micron and 1.0 mm,
(d) a solubilizing or dispersion aid mixed with said substance and also absorbed into the substrate,
(e) and a hardener mixed with said substance and aid and also absorbed into the substrate,
(f) between 1% and 90% of the bead weight being defined by the substrate and between about 0.5% and 75% of the bead weight defined by said substance, and said mix consisting of from about 1% to 100% by weight of said substance, from about 1% to 100% by weight of said solubilizing or dispersion aid, and from about 0.1% to 100% by weight of said hardener.

2. The bead of claim 1 wherein the bead has a cross dimension within the range 0.05 to 4.0 mm.

3. The bead of claim 2 wherein the substrate is selected from the group that consists of puffed borax, dendritic salt, and clay.

4. The bead of claim 3 where said substance comprises a material selected from the group consisting of quaternary ammonium compounds and imadazolinimum compounds.

5. The bead of 1 wherein said solubilizing or dispersion aid is a nonionic surfactant.

6. The bead of claim 5 where said nonionic surfactant is selected from the group consisting of ($x_1$) condensation products of aliphatic alcohol with ethylene oxide
($x_2$) polyethylene oxide condensates of alkyl phenols
($x_3$) condensate products of ethylene oxide and an organic hydrophobic base
($x_4$) tertiary amine oxides
($x_5$) sulfoxide surfactants
($x_6$) phosphine oxide surfactants.

7. The bead of claim 1 wherein said solubilizing or dispersion aid is selected from the group consisting of ($x_1$) ampholytic surfactants which contain both anionic and cationic moieties,
($x_2$) Zwitterionic surfactants which also contain both anionic and cationic moieties,
($x_3$) fatty acid soap.

8. The bead of claim 1 wherein the barrier coating is in finely divided solid form.

9. A cleaning composition comprising multiple beads as defined in claim 1 admixed with dry laundry detergent.

10. A cleaning composition comprising multiple beads as defined in claim 1 admixed with carbonate based dry laundry detergent.

11. A composition comprising multiple beads as defined in claim 2 admixed with laundry detergent, and wherein the beads comprise between 0.01 and 50.0 percent , by weight, of the composition.

12. A composition comprising multiple beads as defined in claim 1 admixed with a laundry mix, and wherein the beads comprise between about 6.4 and 12.0 percent, by weight, of the composition, the laundry mix selected from the group that consists essentially of:

(i)
sodium linear dodecyl-benzene sulfonate
sodium silicate
sodium carbonate
sodium sulfate
(ii)
sodium chloride
sodium percarbonate
a powder or flake containing about 81% sodium linear dodecyl-benzene sulfonate, and the balance moisture and sodium sulfate
sodium carboxymethyl cellulose
(iii)
sodium linear dodecyl-benzene sulfonate
sodium tripolyphosphate
sodium silicate
sodium carboxymethyl cellulose
sodium sulfate
(iv)
sodium sesquicarbonate
sodium carbonate
sodium chloride
sodium carboxymethyl cellulose
sodium linear dodecyl-benzene sulfonate
(v)
sodium linear dodecyl-benzene sulfonate
sodium carbonate
sodium silicate
sodium sulfate.

13. The bead as defined in claim 4 comprising
(i) about 1% to 50% by weight of said porous substrate
(ii) about 0.5% to 75% by weight of said substance
(iii) about 1% to 30% by weight of said barrier.

14. The bead as defined in claim 13 wherein said substance comprises a mixture whose components comprise:
from about 1% to 100% by weight of said material
from about 1% to 100% by weight of a solubilizing or dispersing aid,
from about 0.1 to 25% by weight of a hardener.

15. The method of producing a bead useful in a fabric aqueous laundering process to impart to the fabric, when dried, at least one of the following properties: (i) softness, and (ii) antistatic effectiveness, said method including:
($x_1$) mixing porous substrate granules with a cationic substance that imparts at least one of said (i) and (ii) properties to the fabric, and
($x_2$) continuing said mixing until said substance is absorbed into the porous substrate,
($x_3$) and thereafter coating said granules and said substance absorbed therein with a barrier that resists tackiness of the beads, and that is dispersing in laundry wash water, and to a coating thickness between about 1 micron and 1.0 mm, the barrier consisting of an ingredient selected from the group that consists of amorphous silica, inorganic salts, and powdered dyes,
($x_4$) there being a solubilizing or dispersion aid mixed with said substance and also absorbed into the substrate,
($x_5$) and a hardener mixed with said substance and aid and also absorbed into the substrate,
($x_6$) between 1% and 90% of the bead weight being defined by the substrate and between about 0.5% and 75% of the bead weight defined by said substance, and said mix consisting of from about 1% to 100% by weight of said substance, from about 1% to 100% by weight of said solubilizing or dispersion aid, and from about 0.1% to 100% by weight of said hardener.

16. The method of claim 15 wherein said substrate is selected from the group that consists of puffed borax, dendritic salt, and clay.

17. The method of claim 16 wherein said substance comprises a material selected from the group consisting of quaternary ammonium compounds and imadazolinimum compounds.

18. The method of treating fabrics in the laundry wash cycle wherein detergent is employed for cleaning, that comprises charging into the wash water multiple beads each consisting of
(a) a porous substrate,
(b) and cationic substance absorbed into said substrate to produce at least one of the properties (i) softness, and (ii) antistatic effect in the fabric,
(c) and a water dispersible barrier on the substrate and covering said absorbed substance to allow rapid release of said substance upon dispersing of the barrier.

19. The method of claim 18 wherein said substrate is selected from the group that consists of puffed borax, dendritic salt, and clay.

20. The method of claim 19 wherein said substance comprises a material selected from the group consisting of quaternary ammonium compounds and imadazolinimum compounds.

21. The method of claim 20 wherein each bead is coated with said water dispersable barrier to a coating thickness of between 1 micron and 1.0 mm.

22. The method of claim 19 wherein said beads are admixed with said detergent in dry form during said charging.

23. A composition comprising multiple beads as defined in claim 1 admixed with a detergent composition whose members comprise a surfactant selected from the group consisting of nonionic, zwitterionic and amphoteric surfactants; anionic surfactant selected from the group consisting of alkali metal, ammonia or amine salts of alkylbenzene sulfonate, ethoxylated sulfates, alpha olefin sulfonates and alcohol sulfates; builder salt selected from the group consisting of alkali metal salts of polyphosphates, orthophosphates, silicates, sulfate, chlorine, citrate, carbonate, bi-carbonate, zeolites, nitrilotriacetic acid, and ethylenediaminetriacetic acid; and additives selected from the following: bleaching agents, bleach activators, suds boosters or suppressors, anticorrosion agents, soil suspending agents, soil release agents, optical brighteners, hydrotropes, enzymes, water softeners and perfumes.

* * * * *